US009003853B2

(12) United States Patent
Tsuda

(10) Patent No.: US 9,003,853 B2
(45) Date of Patent: Apr. 14, 2015

(54) ROLLER HEMMING DEVICE

(75) Inventor: Satoshi Tsuda, Toyota (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 60 days.

(21) Appl. No.: 13/978,226

(22) PCT Filed: Jan. 7, 2011

(86) PCT No.: PCT/JP2011/050212

§ 371 (c)(1),
(2), (4) Date: Jul. 3, 2013

(87) PCT Pub. No.: WO2012/093494

PCT Pub. Date: Jul. 12, 2012

(65) Prior Publication Data

US 2013/0276500 A1 Oct. 24, 2013

(51) Int. Cl.
*B21D 39/02* (2006.01)

(52) U.S. Cl.
CPC ..... *B21D 39/023* (2013.01)

(58) Field of Classification Search
USPC ..... 72/210, 211, 214, 220, 252.5; 492/1, 492/30; 29/243.57, 243.58, 795, 796
See application file for complete search history.

(56) References Cited

U.S. PATENT DOCUMENTS

| | | | | |
|---|---|---|---|---|
| 5,024,076 | A * | 6/1991 | Warner | 72/211 |
| 5,224,253 | A * | 7/1993 | Sawa | 29/243.58 |
| 6,425,277 | B2 * | 7/2002 | Wiens | 72/210 |
| 6,640,599 | B1 | 11/2003 | Persson | |
| 7,124,611 | B2 | 10/2006 | Baulier et al. | |
| 2009/0235505 | A1 * | 9/2009 | Toeniskoetter et al. | 29/243.58 |
| 2011/0170946 | A1 | 7/2011 | Schneegans et al. | |

FOREIGN PATENT DOCUMENTS

| | | | |
|---|---|---|---|
| JP | 5-253626 | A | 5/1993 |
| JP | 5-78327 | | 10/1993 |
| JP | 07-299526 | A | 11/1995 |
| JP | 9-234527 | A | 9/1997 |
| JP | 2000-237830 | A | 9/2000 |
| JP | 2001-347326 | A | 12/2001 |
| JP | 2002-35865 | A | 2/2002 |
| JP | 2002-102957 | A | 4/2002 |
| JP | 2002-538968 | A | 11/2002 |
| JP | 2010-515584 | A | 5/2010 |
| KR | 10-2010-0093971 | A | 8/2010 |
| WO | 03/004189 | A1 | 1/2003 |

OTHER PUBLICATIONS

Espacenet, English-language translation of abstract of JP2002035865A, published Feb. 5, 2002.

(Continued)

*Primary Examiner* — Debra Sullivan
(74) *Attorney, Agent, or Firm* — Kenyon & Kenyon LLP

(57) ABSTRACT

Disclosed is a roller hemming device capable of maintaining performance to hem a work at low cost. Specifically disclosed is a roller hemming device for performing preliminary bending to a work placed on a bottom die along a guide surface formed on the bottom die, which includes a roller for hemming the work, and a guide member protruding radially outward from the outer circumferential surface of the roller. The guide member is in contact with the guide surface of the bottom die during the preliminary bending.

3 Claims, 3 Drawing Sheets

(56) References Cited

OTHER PUBLICATIONS

English-language machine translation of JP2002035865.
Espacenet, English-language translation of abstract of WO0054902, corresponding to JP2002538968, published Nov. 19, 2002.
Espacenet, English-language translation of abstract of JP2002102957, published Apr. 9, 2002.
English-language machine translation of JP2002-102957A.
Espacenet, English-language abstract of US2011170946A1, corresponding to JP2010515584A.
Espacenet, English-language abstract of WO03004189.
H05-78327 U, English-language translation (partial) of JP5-78327.
Espacenet, English-language abstract of US7124611.
Patent Abstracts of Japan, English-language abstract corresponding to JP05-253626.
English-language machine translation of JP05-253626.
Espacenet, English-language abstract of JPH09234527.
English-language machine translation of JP09-234527.
Espacenet, English-language translation of abstract of JP20000237830.
English-language machine translation of JP 2000-237830.
Espacenet, English-language abstract of JP2001347326 A.
English-language machine translation of JP2001347326 A.

* cited by examiner

ROLLER HEMMING DEVICE

CROSS REFERENCE TO RELATED APPLICATION

This is a national phase application based on the PCT International Patent Application No. PCT/JP2011/050212 filed on Jan. 7, 2011, the entire contents of which are incorporated herein by reference.

TECHNICAL FIELD

The present invention relates to a roller hemming device for hemming a work by use of a roller.

BACKGROUND ART

Conventionally, a roller hemming device is widely known that is configured to perform bending (preliminary bending) of a standing flange of a work such as a door subassembly of a car at a predetermined angle by use of a roller, and then to perform bending (final bending) of the flange at a final angle by use of the roller.

In the roller hemming device mentioned above, during the preliminary bending, for the purpose of stability of an attitude of the roller, the roller is rolled along a guide surface formed on a bottom die on which the work is placed with the outer circumferential surface of the roller being in contact with the guide surface (e.g. see Patent Literature 1).

Consequently, a portion of the roller which comes in contact with the guide surface gradually abrades, which leads to difficulty in hemming the work in a constant condition.

In the present circumstances, to prevent defects resulted from abrasion of the roller, the roller having a predetermined quantity of abrasion is replaced with a new one. However, it is disadvantageous in that a running cost of the roller hemming device is high since the whole roller has to be replaced.

CITATION LIST

Patent Literature

Patent Literature 1: JP 2002-35865 A

SUMMARY OF INVENTION

Problem to be Solved by the Invention

The objective of the present invention is to provide a roller hemming device capable of maintaining performance to hem a work at low cost.

Means for Solving the Problem

A first aspect of the present invention is a roller hemming device for performing preliminary bending to a work placed on a bottom die along a guide surface formed on the bottom die, which includes a roller for hemming the work, and a guide member independent from the roller. The roller has a groove in which the outer circumferential surface of the roller is recessed toward the radial inside of the roller throughout the circumference of the roller. The guide member is provided in the groove so as to protrude radially outward of the outer circumferential surface of the roller, and is in contact with the guide surface of the bottom die during the preliminary bending.

Preferably, the guide member is configured so that each of a radial position and an axial position thereof relative to the roller is adjusted by means of at least one shim.

Advantageously, the roller is formed in a circular truncated cone.

Effects of the Invention

The present invention makes it possible to hem a work in a constant condition at low cost.

DESCRIPTION OF EMBODIMENTS

First Embodiment

With reference to FIGS. 1 to 5, described below is a roller hemming device 1 as a first embodiment of a roller hemming device according to the present invention.

The roller hemming device 1 is a device for hemming a work W, and is attached to a robot arm (not shown).

Figure 3:
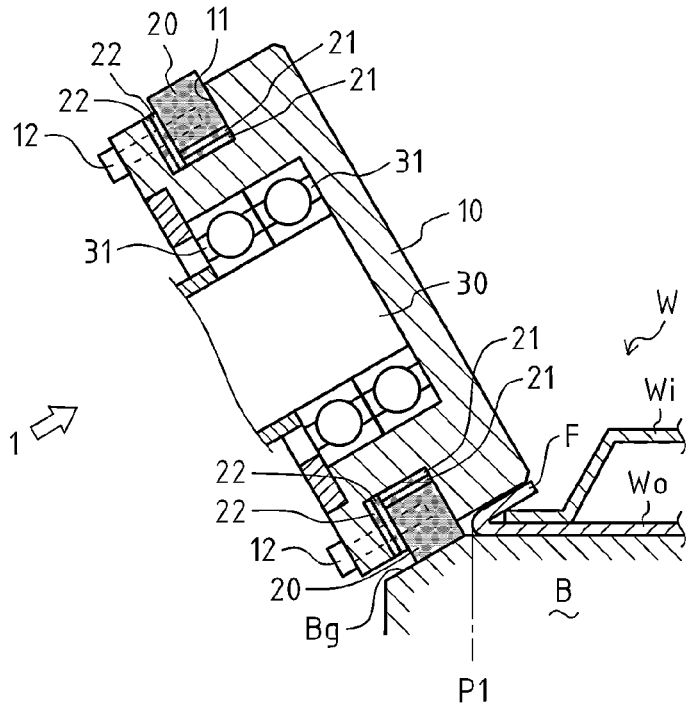
FIG. 3 shows how the roller hemming device preliminarily bends a work.

The work W includes an outer panel Wo which has a standing flange F and which is placed on a bottom die B, and an inner panel Wi which is placed on the outer panel Wo and which is arranged to the left of the flange F (see FIG. 3).

The bottom die B is a member on which the work W is so placed that the outer panel Wo comes in contact with the bottom die B.

Figure 1:
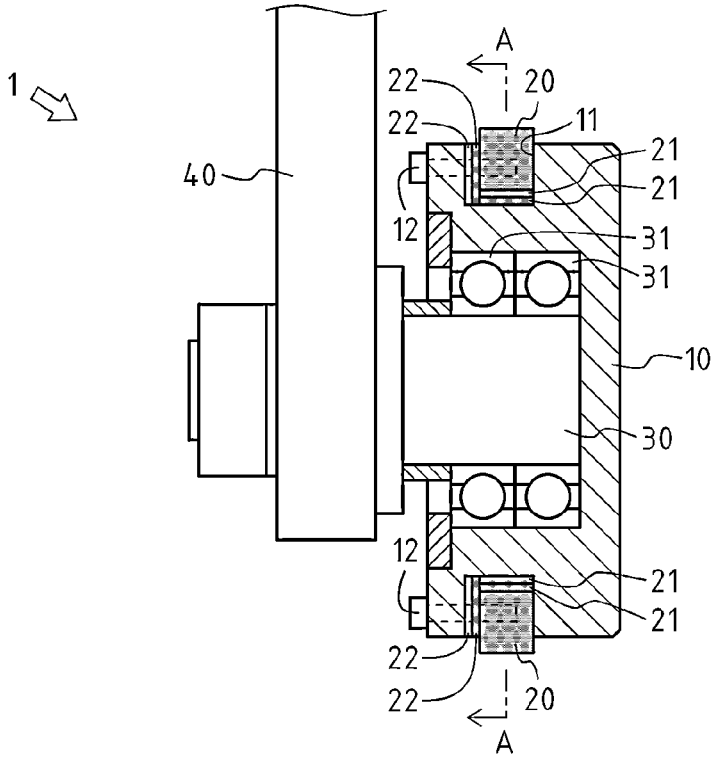
FIG. 1 illustrates a roller hemming device according to a first embodiment of the present invention.

Note that a top-bottom direction in FIG. 1 is defined as a top-bottom direction of the roller hemming device 1.

Figure 2:
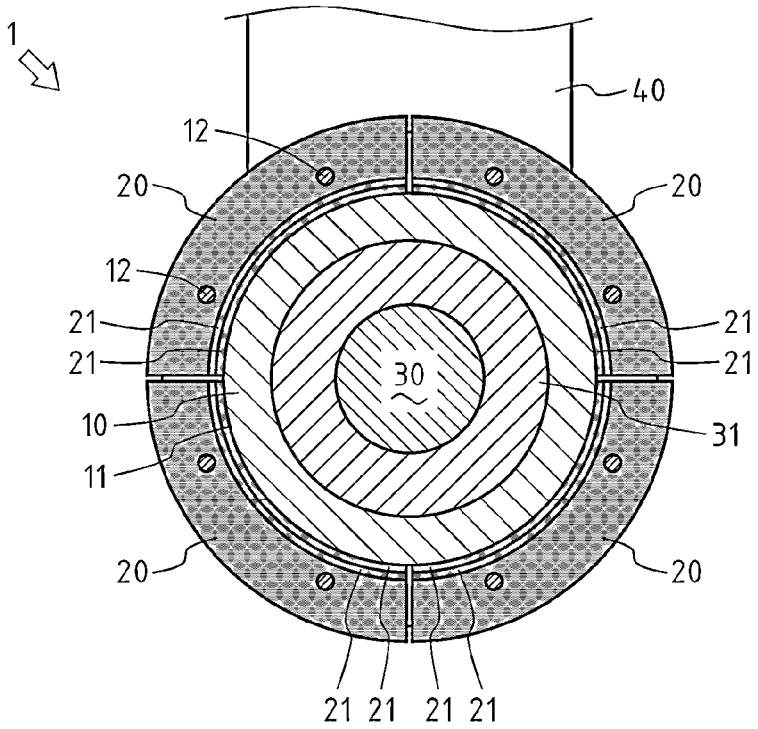
FIG. 2 is a sectional view taken along the line A-A in FIG. 1.

As shown in FIGS. 1 and 2, the roller hemming device 1 includes a roller 10, four guide members 20, a shaft 30, and an attached member 40.

The roller 10 is formed in substantially a cylinder, and is rotatably supported by the shaft 30.

The roller 10 has a groove 11 which is formed by recessing the outer circumferential surface thereof toward the radial inside throughout the circumference thereof.

Note that, hereinafter, an axial direction of the roller 10 is referred to as simply "an axial direction", and a radial direction of the roller 10 is referred to as simply "a radial direction".

The groove 11 is formed by recessing the outer circumferential surface of the roller 10 toward the radial inside throughout the circumference of the roller 10. The groove 11 has a rectangular shape in a section taken along the axis of the roller 10 (see FIG. 1). The groove 11 is perpendicular to the axial direction, and is situated in a vicinity of the attached member 40.

The groove 11 is configured so that the guide members 20 are attached thereto.

Each of the guide members 20 is a steel material with strength substantially equal to or higher than that of the roller 10. Since each of the guide members 20 is formed in an arc, the four guide members 20 form an annular shape if the ends thereof are joined to each other. In other words, the guide members 20 are produced by dividing an annular member into four equal parts. Each of the guide members 20 has a rectangular section as with the groove 11. The four guide members 20 are fixed in the groove 11 so that the outer circumferential surfaces thereof are situated radially outward of the outer circumferential surface of the roller 10. On the end surface of each guide member 20 close to the attached member 40, two bolt-holes being apart from each other in the circumferential direction of the roller 10 are formed. Each of the guide members 20 is fixed in the groove 11 by screwing bolts 12 into the bolt-holes from the end surface of the roller 10 close to the attached member 40. Note that a plurality of through-holes (eight through-holes in the present embodiment) each of which the bolt 12 passes through are formed in the roller 10 to coincide in position with the bolt-holes of the guide members 20.

Each of the guide members 20 is configured so that a position thereof in the groove 11 is adjusted by means of a radial shim 21 and an axial shim 22.

The radial shim 21 is an arc-shaped shim extending along the inner circumferential surface (the surface on the radial inside) of the guide member 20 while maintaining a thickness (a radial dimension) thereof. The four radial shims 21 form an annular shape if the ends thereof are joined to each other, as with the four guide members 20. The radial shim 21 is provided between the inner circumferential surface of the guide member 20 and the bottom surface (the surface parallel to the outer circumferential surface of the roller 10) of the groove 11 so as to be contiguous with those surfaces, thereby enabling to adjust a radial position of the guide member 20 depending on the number of the radial shims 21 to be provided. In other words, a distance between the guide member 20 and the roller 10 increases as the number of the radial shims 21 to be provided increases. Note that the guide member 20 has such dimensions that the guide member 20 protrudes radially outward from the outer circumferential surface of the roller 10 regardless of the number of the radial shims 21 to be provided.

Thus, the radial shim 21 is configured to adjust the distance between the guide member 20 and the roller 10.

In the present embodiment, two radial shims 21 are provided for one guide member 20.

Moreover, each of the through-holes which is formed in the roller 10 and which the bolt 12 passes through has an oval shape in which the major axis thereof extends in the radial direction as seen from the axial direction so that the bolt 12 comes out of interference with the roller 10 when the radial position of each guide member 20 is adjusted.

The axial shim 22 is an arc-shaped shim extending along the end surface of the guide member 20 close to the attached member 40 while maintaining a thickness (an axial dimension) thereof. The four axial shims 22 form an annular shape if the ends thereof are joined to each other, as with the four guide members 20. The axial shim 22 is provided between the end surface of the guide member 20 close to the attached member 40 and the lateral surface (the surface parallel to the axial end surface of the roller 10) of the groove 11 close to the attached member 40 so as to be contiguous with those surfaces, thereby enabling to adjust an axial position of the guide member 20 depending on the number of the axial shims 22 to be provided. In other words, a distance between the guide member 20 and the attached member 40 increases as the number of the axial shims 22 to be provided increases.

Thus, the axial shim 22 is configured to adjust the axial position of the guide member 20 relative to the roller 10.

In the present embodiment, two axial shims 22 are provided for one guide member 20.

The shaft 30 supports the roller 10 in a rotatable manner. Specifically, one end portion (the right end portion in FIG. 1) of the shaft 30 supports the roller 10 in a rotatable manner through two bearings 31.

The bearings 31 are provided between the outer circumferential surface of the shaft 30 and the inner circumferential surface of the roller 10, and are arranged adjacent to each other in the axial direction.

The attached member 40 extends in the top-bottom direction. The attached member 40 is configured so that the other end portion (the left end portion in FIG. 1) of the shaft 30 is fixed to the bottom end portion of the attached member 40 with the attached member 40 and the shaft 30 being perpendicular to each other. The upper portion of the attached member 40 is fixed to the robot arm through suitable members (not shown).

In the roller hemming device 1 attached to the robot arm as mentioned above, the roller 10 rolls on the flange F while pressing the flange F of the outer panel Wo of the work W, thereby hemming the work W.

As shown in FIG. 3, when the roller hemming device 1 performs the preliminary bending for bending the flange F of the outer panel Wo of the work W at a predetermined angle, the roller 10 rolls on the flange F in a state where a portion of the outer circumferential surface of the roller 10 in which the groove 11 is not formed, namely, a portion of the outer circumferential surface of the roller 10 opposite to the attached member 40 comes in contact with the flange F, and where the outer circumferential surface of the guide member 20 fixed in the groove 11 of the roller 10 comes in contact with a guide surface Bg of the bottom die B.

The guide surface Bg is formed on the bottom die B, and is inclined parallel to the preliminarily bent flange F.

Note that P1 in FIG. 3 indicates a position (a position of a root of the flange F) in which the work W is bent.

Thus, the annular guide members 20 rolls on the guide surface Bg of the bottom die B, and the roller 10 performs the preliminary bending to the flange F of the outer panel Wo of the work W.

Consequently, the guide members 20 are guided by the guide surface Bg of the bottom die B, and the roller 10 rolls on the flange F while inclining at an inclined angle of the guide surface Bg. This makes it possible to stabilize an attitude of the roller 10, and to perform the preliminary bending to the flange F with accuracy.

Moreover, when a predetermined quantity of abrasion occurs in the guide members 20 rolling on the guide surface Bg, the guide members 20 may easily be replaced with new ones by removing the bolts 12 from each guide member 20.

This makes it possible to hem the work W with accuracy at low cost as compared with a case where a whole roller is replaced in a conventional roller hemming device.

As mentioned previously, the guide members 20 is configured so that a radial position thereof is adjusted by means of the radial shims 21, and that an axial position thereof is adjusted by means of the axial shims 22.

Figure 4:
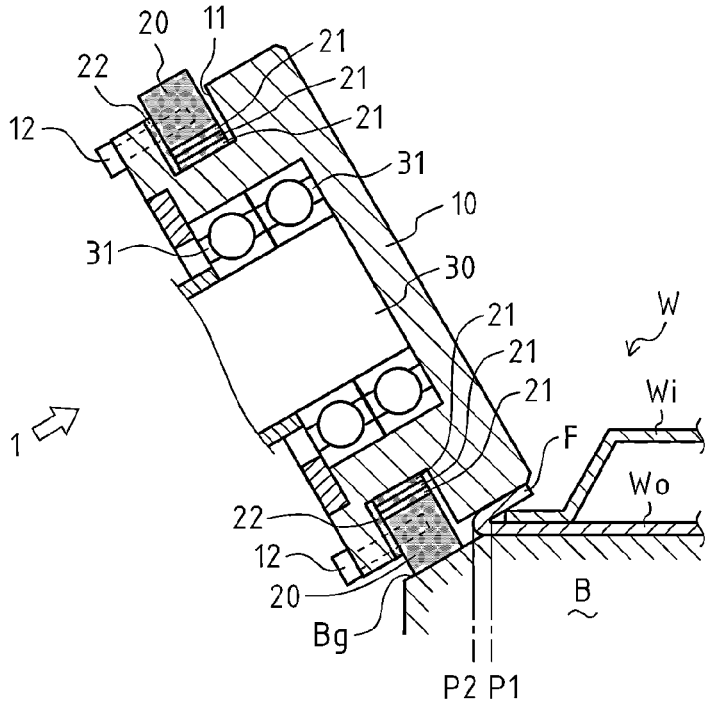
FIG. 4 shows how the roller hemming device preliminarily bends a work in which a position of a part to be bent is changed.

As shown in FIG. 4, in a case where a position in which the work W is to be bent is changed (a bending profile of the outer panel Wo is changed) from P1 to P2 and the flange F comes close to the guide surface Bg of the bottom die B, a position of the guide member 20 is adjusted by adding one radial shim 21 and subtracting one axial shim 22.

This makes it possible to roll the roller 10 with the outer circumferential surface of the guide members 20 being in contact with the guide surface Bg of the bottom die B, without modifying the guide surface Bg by overlaying the bottom die B, in the same manner as before a position in which the work W is to be bent is changed.

Figure 5:
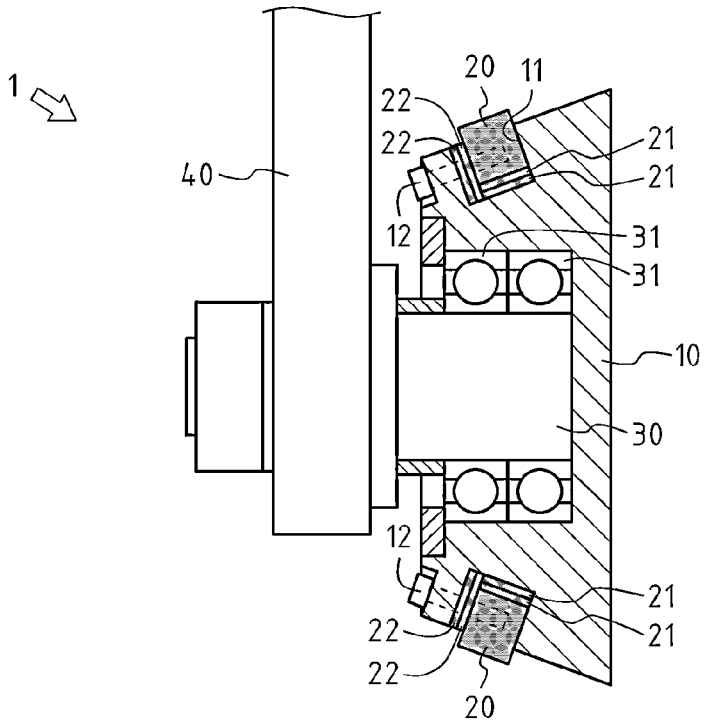
FIG. 5 illustrates the roller hemming device having a roller formed in a circular truncated cone.

As shown in FIG. 5, the roller 10 may be formed in a circular truncated cone.

In this case, the roller 10 is rolled on the flange F so that the large-diameter portion (the portion opposite to the attached member 40) of the roller 10 comes in contact with the tip portion of the flange F. Consequently, a difference in outer diameter between the portion of the roller 10 in contact with the tip portion of the flange F and the portion of the roller 10 in contact with the base portion of the flange F provides a reduction of a difference of stresses generated on the tip portion and base portion of the flange F. Specifically, the roller 10 formed in a circular truncated cone generally rolls along the inclined outer circumferential surface thereof so as to describe a circular trajectory. However, the roller 10 is controlled by the robot arm to linearly roll on the flange F, and therefore a tensile stress is generated on the base portion of the flange F, which provides a reduction of a difference of stresses generated on the tip portion and base portion of the flange F. This makes it possible to minimize defects such as waving of the hemmed flange F.

Moreover, since the outer circumferential surface of the roller 10 inclines relative to a horizontal plane, the roller hemming device 1 may bend the flange F at a predetermined angle without an inclination of the roller hemming device 1. Therefore, in a case where a plurality of roller hemming devices 1 perform hemming process at the same time, the plurality of roller hemming devices 1 may be prevented from interference with each other resulted from an inclination thereof.

In the present embodiment, four guide members 20 are provided in the groove 11 of the roller 10, but the number of the guide members 20 is not limited as long as the guide members 20 form an annular shape when combined with each other. Moreover, the numbers of the radial shims 21 and the axial shims 22 may depend on the number of the guide members 20.

Second Embodiment

Figure 6:
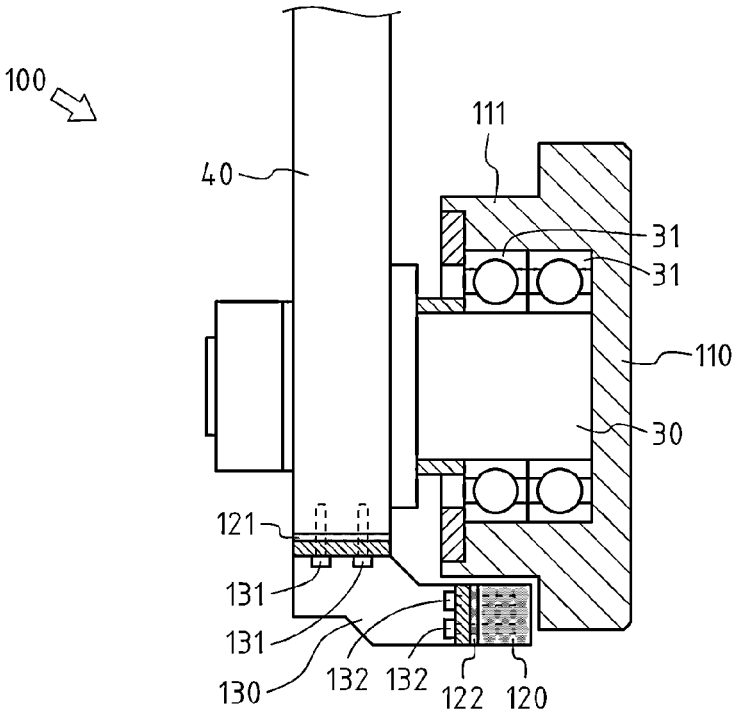
FIG. 6 illustrates a roller hemming device according to a second embodiment of the present invention.

With reference to FIG. 6, described below is a roller hemming device 100 as a second embodiment of a roller hemming device according to the present invention.

The roller hemming device 100 is, as with the roller hemming device 1, controlled by the robot arm (not shown) to hem the work W.

Note that, hereinafter, the parts common to the roller hemming device 1 and the roller hemming device 100 are indicated by same reference signs, and descriptions thereof are omitted.

As shown in FIG. 6, the roller hemming device 100 includes a roller 110, a guide member 120, and a bracket 130.

The roller 110 is formed in substantially a cylinder, and is rotatably supported by the shaft 30.

The roller 110 has a small-diameter portion 111 with a relatively small outer diameter.

The small-diameter portion 111 is formed in substantially a cylinder from the end surface of the roller 110 close to the attached member 40 to the middle in the axial direction of the roller 110. The small-diameter portion 111 has a smaller outer diameter than that of the portion (the portion opposite to the attached member 40) for hemming the work W in the outer circumferential surface of the roller 110, thereby preventing the roller 110 from coming in contact with the guide member 120.

The guide member 120 is made of a material similar to that of the guide member 20, and is formed in a rectangular cuboid. The guide member 120 is arranged below the small-diameter portion 111 so as to come out of contact with the roller 110. The guide member 120 protrudes below the outer circumferential surface of the roller 110.

The bracket 130 supports the guide member 120 and is fixed to the bottom end portion of the attached member 40. The bracket 130 extends from the bottom end portion of the attached member 40 to the end surface of the guide member 120 close to the attached member 40 so as to come out of contact with the roller 110. The bracket 130 is fixed to the attached member 40 from below by means of bolts 131, and is fixed to the guide member 120 from the attached member 40 side by means of bolts 132.

Thus, the guide members 20 of the roller hemming device 1 rotate integrally with the roller 10, whereas the guide member 120 of the roller hemming device 100 is held at a fixed position independently from the roller 110.

The guide member 120 is, as with the guide member 20, configured so that a position thereof is adjusted by means of a radial shim 121 and an axial shim 122.

The radial shim 121 is a plate-shaped shim. The radial shim 121 is provided between the attached member 40 and the bracket 130, thereby enabling to adjust a radial position of the guide member 120 depending on the number of the radial shims 121 to be provided. In other words, the bracket 130 is situated at a lower position as the number of the radial shims 121 to be provided increases, and consequently the guide member 120 is situated at a lower position.

In the present embodiment, one radial shim 121 is provided.

The axial shim 122 is a plate-shaped shim. The axial shim 122 is provided between the guide member 120 and the bracket 130, thereby enabling to adjust an axial position of the guide member 120 depending on the number of the axial shims 122 to be provided. In other words, a distance between the guide member 120 and the attached member 40 increases as the number of the axial shims 122 to be provided increases.

In the present embodiment, one axial shim 122 is provided.

The roller hemming device 100 configured as mentioned above is controlled by the robot arm so that the roller 110 rolls on the flange F while pressing the flange F of the outer panel Wo of the work W, thereby hemming the work W.

At this time, the roller 110 performs the preliminary bending to the flange F of the outer panel Wo of the work W with the guide member 120 being in contact with the guide surface Bg of the bottom die B.

Consequently, the guide member 120 are guided by the guide surface Bg of the bottom die B, and the roller 110 rolls on the flange F while inclining at an inclined angle of the guide surface Bg. This makes it possible to stabilize an attitude of the roller 110, and to perform the preliminary bending to the flange F with accuracy.

Moreover, when a predetermined quantity of abrasion occurs in the guide member 120 in contact with the guide surface Bg, the guide member 120 may easily be replaced with new one by removing the bolts 132.

This makes it possible to hem the work W with accuracy at low cost as compared with a case where a whole roller is replaced in a conventional roller hemming device.

INDUSTRIAL APPLICABILITY

The present invention is applied to a roller hemming device for performing preliminary bending of a work along a guide surface of a bottom die.

REFERENCE SIGNS LIST

1: roller hemming device
10: roller
11: groove
20: guide member
21: radial shim
22: axial shim
30: shaft
40: attached member
W: work
B: bottom die
Bg: guide surface

The invention claimed is:

1. A roller hemming device for performing preliminary bending to a work placed on a bottom die along a guide surface formed on the bottom die, comprising:

a roller for hemming the work; and a guide member independent from the roller, wherein the roller has a groove in which the outer circumferential surface of the roller is recessed toward the radial inside of the roller throughout the circumference of the roller, and the guide member is provided in the groove so as to protrude radially outward of the outer circumferential surface of the roller, and is in contact with the guide surface of the bottom die during the preliminary bending.

2. The roller hemming device according to claim 1, wherein the guide member is configured so that each of a radial position and an axial position thereof relative to the roller is adjusted by means of at least one shim.

3. The roller hemming device according to claim 1, wherein the roller is formed in a circular truncated cone.

* * * * *